US008873779B2

(12) United States Patent
Lugger

(10) Patent No.: US 8,873,779 B2
(45) Date of Patent: Oct. 28, 2014

(54) HEARING APPARATUS WITH OWN SPEAKER ACTIVITY DETECTION AND METHOD FOR OPERATING A HEARING APPARATUS

(71) Applicant: Siemens Medical Instruments Pte. Ltd., Singapore (SG)

(72) Inventor: Marko Lugger, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 14 days.

(21) Appl. No.: 13/709,224

(22) Filed: Dec. 10, 2012

(65) Prior Publication Data

US 2013/0148829 A1 Jun. 13, 2013

(30) Foreign Application Priority Data

Dec. 8, 2011 (DE) ..... 10 2011 087 984

(51) Int. Cl.
*H04R 25/00* (2006.01)

(52) U.S. Cl.
CPC ..... *H04R 25/00* (2013.01); *H04R 25/505* (2013.01); *H04R 25/407* (2013.01)
USPC ..... 381/312; 381/314

(58) Field of Classification Search
CPC ..... H04R 25/70; H04R 25/50; H04R 2225/43
USPC ..... 381/312, 314, 317
See application file for complete search history.

(56) References Cited

U.S. PATENT DOCUMENTS

| | | | | |
|---|---|---|---|---|
| 7,340,231 | B2 | 3/2008 | Behrens et al. | |
| 7,853,031 | B2 | 12/2010 | Hamacher | |
| 2003/0156722 | A1* | 8/2003 | Taenzer | 381/92 |
| 2005/0210355 | A1* | 9/2005 | Itoh et al. | 714/748 |
| 2006/0262944 | A1* | 11/2006 | Rasmussen et al. | 381/110 |
| 2007/0100605 | A1 | 5/2007 | Renevey et al. | |
| 2008/0260180 | A1* | 10/2008 | Goldstein et al. | 381/110 |
| 2011/0046948 | A1 | 2/2011 | Pedersen | |
| 2011/0071837 | A1* | 3/2011 | Yonekubo et al. | 704/270 |
| 2011/0150256 | A1* | 6/2011 | Baechler et al. | 381/316 |
| 2011/0255702 | A1 | 10/2011 | Jensen | |
| 2011/0261983 | A1* | 10/2011 | Claussen et al. | 381/317 |

FOREIGN PATENT DOCUMENTS

| | | | |
|---|---|---|---|
| DE | 10137685 | C1 | 12/2002 |
| DE | 602 04 902 | T2 | 5/2006 |
| DE | 10 2005 032 274 | A1 | 1/2007 |
| WO | 2005020633 | A1 | 3/2005 |

* cited by examiner

*Primary Examiner* — Ahmad Matar
*Assistant Examiner* — Katherine Faley
(74) *Attorney, Agent, or Firm* — Laurence A. Greenberg; Werner H. Stemer; Ralph E. Locher

(57) ABSTRACT

A method and device for reliably detecting one's own voice being the wearer of a hearing apparatus. A hearing apparatus includes at least two independent analysis facilities, of which each is configured to obtain speech activity data on the basis of an audio signal received by the hearing apparatus, which is dependent on the speaker activity of a wearer of the hearing apparatus. A fusion facility is configured to receive the speech activity data from the analysis facilities and on the basis of the speech activity data then to recognize whether or not the wearer is currently speaking.

15 Claims, 2 Drawing Sheets

HEARING APPARATUS WITH OWN SPEAKER ACTIVITY DETECTION AND METHOD FOR OPERATING A HEARING APPARATUS

CROSS-REFERENCE TO RELATED APPLICATION

This application claims the priority, under 35 U.S.C. §119, of German application DE 10 2011 087 984.6, filed Dec. 8, 2011; the prior application is herewith incorporated by reference in its entirety.

BACKGROUND OF THE INVENTION

Field of the Invention

The invention relates to a hearing apparatus, which is configured to automatically detect whether or not a wearer of the hearing apparatus is currently speaking. The invention also includes a method for operating a hearing apparatus, by which whether the wearer of the hearing apparatus is speaking can likewise be automatically detected. The term "hearing apparatus" is understood here to mean any sound-emitting device which can be worn in or on the ear, in particular a hearing device, a headset or earphones.

Hearing devices are wearable hearing apparatuses which are used to provide hearing assistance to the hard-of-hearing. In order to accommodate the numerous individual requirements, various designs of hearing devices are available such as behind-the-ear (BTE) hearing devices, hearing device with external earpiece (RIC: receiver in the canal) and in-the-ear (ITE) hearing devices, for example also concha hearing devices or completely-in-the-canal (ITE, CIC) hearing devices. The hearing devices listed as examples are worn on the outer ear or in the auditory canal. Bone conduction hearing aids, implantable or vibrotactile hearing aids are also available on the market. With these devices the damaged hearing is stimulated either mechanically or electrically.

The key components of hearing devices are principally an input transducer, an amplifier and an output transducer. The input transducer is normally a sound transducer e.g. a microphone and/or an electromagnetic receiver, e.g. an induction coil. The output transducer is most frequently realized as an electroacoustic transducer, e.g. a miniature loudspeaker, or as an electromechanical transducer, e.g. a bone conduction receiver. The amplifier is usually integrated into a signal processing unit. This basic configuration is illustrated in FIG. 1 using the example of a behind-the-ear hearing device. One or more microphones 2 for picking up ambient sound are incorporated into a hearing device housing 1 to be worn behind the ear. A signal processing unit 3 which is also integrated into the hearing device housing 1 processes and amplifies the microphone signals. The output signal from the signal processing unit 3 is transmitted to a loudspeaker or receiver 4, which outputs an acoustic signal. The sound may be transmitted to the device wearer's eardrum by way of an acoustic tube which is fixed in the auditory canal by an ear mold. Power for the hearing device and in particular for the signal processing unit 3 is supplied by a battery 5 which is also integrated in the hearing device housing 1.

Efforts are made in many hearing apparatuses and in particular in hearing devices to keep the listening effort as low as possible if ambient sound is perceived by way of the hearing apparatus. Provision can be made to this end to amplify a speech signal in those spectral bands in which the wearer of the hearing apparatus only hears with difficulty. Another option is to provide a beamformer, which adjusts its directional characteristics such that a main beam of the beamformer always points in the direction from which the voice of a conversational partner of the wearer of the hearing apparatus comes for instance. Such algorithms do not in principle have to change their behavior if the wearer of the hearing apparatus would like to perceive voices from different speakers from different directions. The amplification of the different frequency bands as a function of the hearing ability of the wearer of the hearing apparatus can always remain the same, in other words irrespective of the changing speakers. A beamformer only needs to be able to switch sufficiently quickly between the directions from which the voices of the speaker come alternately.

The situation differs if the wearer of the hearing apparatus is speaking. On account of bone conduction transmission, the wearer always perceives his/her own voice differently for instance than the voice of people in his/her surroundings. If the voice of the wearer is now detected by the hearing apparatus as airborne sound by a microphone and processed in the same way as the voices of other speakers, the wearer of the hearing apparatus therefore perceives his/her own voice as unnatural. In the case of a beamforming, it is not clear during speech activity of the wearer of the hearing apparatus, where the main beam of the beamformer is actually to point. These examples indicate that with a hearing apparatus it is advantageous for many algorithms if, when the audio signal is processed, it is known whether the wearer of the hearing apparatus is currently speaking or whether a detected sound from the surroundings of the wearer strikes the hearing apparatus from an external sound source.

In conjunction with hearing devices, the provision of an additional microphone in an earpiece of a hearing device is known as a current solution for such an own voice detection (OVD), the sound entry opening of which points inside the auditory canal. By comparing the signal of the outer, regular microphone with the signal of the additional microphone, it is possible to detect whether the wearer of the hearing apparatus has generated the audio signal with his/her own voice or whether this is an audio signal from an external sound source. This solution is disadvantageous in that the hearing device has to be equipped both with an additional microphone and also with the required circuit for processing its microphone signal, which correspondingly increases the manufacturing costs of the hearing device. In addition, comparing the two microphone signals only then produces reliable results if the earpiece of the hearing device is fixedly disposed in the auditory canal, so that the inner microphone is adequately shielded from ambient sound. One example of such a hearing device is inferred from published, non-prosecuted German patent application DE 10 2005 032 274 A1, corresponding to U.S. Pat. No. 7,853,031.

U.S. patent publication No. 2006/0262944 A1 describes a signal processing facility for a hearing device, which is embodied so as to detect an own speaker activity on the basis of microphone signals from two microphones. The detection is carried out on the basis of the specific characteristics of a sound field, such as the hearing device wearer's own voice produces on account of the post field effects, and also on the basis of the symmetry of the microphone signals. In addition to the post field detection, the absolute level of the signals and the spectral envelope of the signal spectra can be analyzed in parallel processing blocks. The three analysis blocks each provide a binary signal, which shows whether or not the respective signal block has detected own speech activity. A combination block downstream of the analysis block combines the signals by a logical AND operation into an overall decision.

German patent DE 602 04 902 B2, corresponding to U.S. Pat. No. 7,340,231, describes a programmable communication facility, which, when an own speaker activity is detected, changes a signal processing according to the specifications of a user of the communication facility, in order thus to offer the user the most natural reproduction of his own voice possible. In order to detect the own speaker activity, parameters are extracted from microphone signals, which are then compared with previously learnt parameters, wherein the learnt parameters were determined on the basis of the own voice of the user. Preferred parameters here are on the one hand a level of a low frequency channel and on the other hand the level of a high frequency channel, wherein the two levels are combined in order to decide thereupon whether or not the signal in the two channels is an own voice.

SUMMARY OF THE INVENTION

It is accordingly an object of the invention to provide a hearing apparatus with speaker activity detection and a method for operating a hearing apparatus which overcome the above-mentioned disadvantages of the prior art methods and devices of this general type, which provides reliable own voice detection for a hearing apparatus.

With the foregoing and other objects in view there is provided, in accordance with the invention a hearing apparatus. The hearing apparatus contains at least two analysis facilities. Each of the analysis facilities is configured to obtain speech activity data on a basis of an audio signal received by the hearing apparatus, the audio signal being dependent on speaker activity of a wearer of the hearing apparatus. A fusion facility is configured to receive the speech activity data from the analysis facilities and to identify, on a basis of the speech activity data, whether or not the wearer is currently speaking. At least one of the analysis facilities is configured to determine, in dependence on the audio signal, values for a soft decision or for a probability as to whether the wearer is currently speaking.

The inventive hearing apparatus and the inventive method are not dependent on a comparison of two audio signals which are detected independently of one another. Instead, a reliable and robust own speaker detection is achieved, by audio signals received by the hearing apparatus being examined using more than one type of analysis to determine whether they indicate an own speaker activity. The different analysis results are then combined in a second step in order to provide a reliable statement from the combined information as to whether or not the wearer of the hearing apparatus is currently speaking. The risk of a false own speaker detection is significantly reduced by this fusion of different information sources, since false detection results, such as may result on account of only one individual analysis, are compensated for by the results of another analysis, which are possibly better suited to a specific situation.

In order to realize this knowledge of the invention, the inventive hearing apparatus contains at least two independent analysis facilities, each of which is configured to obtain data on the basis of an audio signal received by the hearing apparatus, which is referred to here as speech activity data, and used such that it is dependent on a speaker activity of the wearer of the hearing apparatus. In conjunction with the invention, the term audio signal is understood here to be an electrical or digital signal which contains signal parts in the audio frequency range. Each of the analysis facilities can be fed an audio signal from another signal source. One and the same audio signal can however also be fed to several analysis facilities. Examples of sources of an audio signal are a microphone, a beamformer or a solid-borne sound sensor.

The speech activity data is obtained by the analysis facilities on the basis of a different analysis criterion in each instance, in other words for instance as a function of a direction of incidence of an ambient sound, as a function of spectral values of a frequency spectrum of the audio signal, on the basis of a speaker-independent speech activity detection or as a function of binaural information, such as can be obtained if audio data is detected on different sides of a head of the wearer.

In order now to be able to make a reliable statement from the speech activity data of the individual analysis facilities as to whether or not the wearer is currently speaking, the inventive hearing apparatus contains a fusion facility, which is configured to receive speech activity data from the analysis facilities and to implement the own speaker detection on the basis of the speech activity data. It may be sufficient here for the fusion facility to be configured in order to detect whether or not the voice of the wearer is active. The identity of the wearer only needs to be detected in a few instances, e.g. during the use of spectral features.

As already described, several audio sources can be used to provide different audio signals. The inventive hearing apparatus can nevertheless be produced in a particularly favorable manner, if only the microphone facility is used by which the ambient sound reaching the wearer is converted into the wanted signal, which is to be presented to the wearer of the hearing apparatus in processed form. A microphone facility here does not necessarily mean an individual microphone. A microphone array or another arrangement containing several microphones can also be used.

In order to be able to suitably react to a speech activity of the wearer detected by the fusion facility, a particularly expedient development of the inventive hearing apparatus contains an adjustment facility, which is configured to change a mode of operation of the hearing apparatus if the wearer is speaking. In particular, provision can be made here for a transmission behavior of the hearing apparatus to be adjusted in order to impart a neutral sound impression of his/her own voice to the wearer of the hearing apparatus. It has proven particularly expedient here to attenuate a low frequency part of the wanted signal in order to prevent the distorted perception of the own voice, which is known as an occlusion effect. In conjunction with an alignable beamforming facility, its directional behavior is expediently adjusted. It is therefore particularly favorable to block the automatic alignment of the directional characteristics while the voice of the wearer is active.

The invention also provides a method for operating a hearing apparatus. According to the method, speech activity data is obtained independently by at least two analysis facilities, i.e. data which is dependent on a speaker activity of a wearer of the hearing apparatus. The speech activity data of the analysis facilities is combined by a fusion facility. On the basis of these combined speech activities, an overall check is then made to determine whether or not the wearer is speaking.

The analysis of the audio signal by the individual analysis facilities and the speech activity detection by the fusion facility can take place in this way in numerous different ways. The inventive method advantageously enables the most varied of analysis methods to be freely combined and to be combined for a reliable and robust overall statement relating to the speech activity. Provision can therefore be made for a feature extraction to be implemented by at least one of the analysis facilities. This means that feature values are determined as a function of the audio signal, like for instance a direction of incidence of a sound which the audio signal has produced, or a reverberation of the audio signal. The features may also be a specific representation of individual segments of the audio signal, like for instance spectral or cepstral coefficients, Linear Prediction Coefficients (LPC). The gender of the speaker (male or female voice) or the result of a phoneme analysis (vocal, fricative, plosive) are conceivable as more abstract features for instance.

It may be just as expedient to already determine a preliminary statement by the analysis facility as to whether the wearer of the hearing apparatus is currently speaking. This takes place in the form of a probability value (value between zero and one). It may however also already be made as a so-called hard or binary decision (is speaking or is not speaking). The latter can be enabled by an analysis facility, which functions as a classifier and to this end checks on the basis of a classification criterion whether or not the wearer is speaking. Such classification criteria are known and available per se for instance from the prior art in conjunction with a so-called speaker-independent voice activity detection (VAD).

If speaker activity data from several analysis facilities now exists, depending on the type of speech activity data, according to one aspect of the invention by the fusion facility, a weighting of the individual speech activity data is implemented. This weighting is then dependent here on the analysis facility from which the respective speech activity data originates. The weighting advantageously achieves here that depending on the current situation, an analysis facility, which as expected in this situation only provides unreliable data, has less influence on the decision result than an analysis facility which is known to operate reliably in this situation. Trainable or untrainable embodiments can be realized here for these weightings. The weighted speech activity data can finally be logically combined, as a result of which the already described information fusion results.

Speech activity data from different analysis facilities can be combined particularly easily if the speech activity data already provides a preliminary decision relating to the speech activity. A majority decision can then be made for instance by the fusion facility, which provides a statement as to whether the analysis facilities together indicate the speaker activity.

Another expedient form of data fusion consists in calculating an average value from the so-called soft decisions of speech activity detectors. Such speech activity detectors can be provided for this purpose with different parameterization in at least two analysis facilities.

The previously described developments of the analysis facilities and the fusion facility relate both to the inventive hearing apparatus and also to the inventive method.

Other features which are considered as characteristic for the invention are set forth in the appended claims.

Although the invention is illustrated and described herein as embodied in a hearing apparatus with speaker activity detection and a method for operating a hearing apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
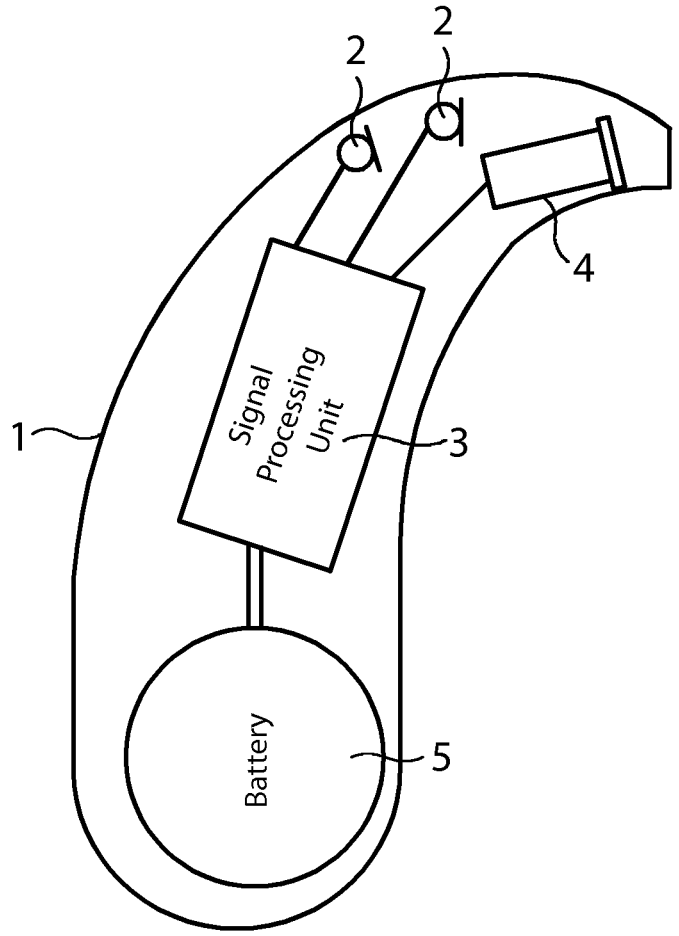
FIG 1 PRIOR ART
FIG. 1 is a schematic representation of a hearing apparatus according to the prior art.
Figure 2:
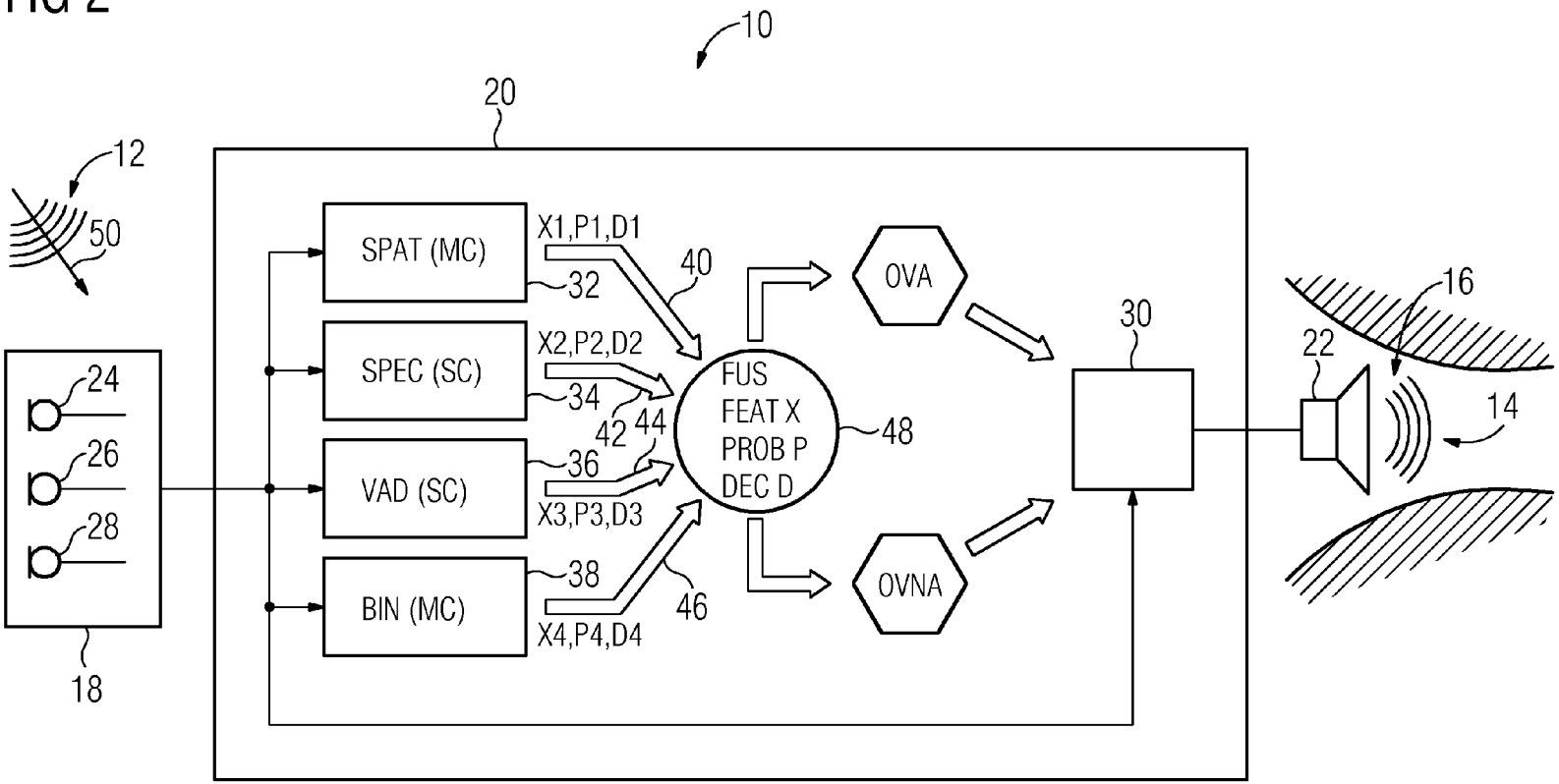
FIG. 2 is a block diagram of the hearing apparatus according to an embodiment of the inventive hearing apparatus.

Referring now to the figures of the drawing in detail and first, particularly, to FIG. 2 thereof, there is shown a hearing apparatus 10, which detects a sound 12 from the surroundings of a wearer of the hearing apparatus. The audio signal of the sound 12 is processed by the hearing apparatus 10 and forwarded as an output sound signal 14 into an auditory canal 16 of the wearer of the apparatus. The hearing apparatus 10 may be a hearing device for instance, such as a behind-the-ear hearing device or an in-the-ear hearing device. The hearing apparatus 10 detects the ambient sound 12 by a microphone facility 18, at which the ambient sound 12 from the surroundings arrives, and which converts the audio signal of the sound 12 into a digital wanted signal. The wanted signal is processed by a processing facility 20 of the hearing apparatus 10 and then radiates in processed form as the output sound 14 through a receiver 22 of the hearing apparatus 10 in the auditory canal 16.

The microphone facility 18 may contain one or more microphones. In FIG. 2, a microphone facility 18 having three microphones 24, 26, 28 is shown by way of example. The microphones 24 to 28 may form a microphone array. They may however also be attached independently of one another, for instance on opposing sides of the head of the wearer of the hearing apparatus. The processing facility 20 may be a digital signal processor for instance. The processing facility 20 may however also be realized by separate or integrated circuits. An earpiece may be a headset or a receiver in the canal (RIC) for instance or also an external hearing device earpiece, the sound of which is routed via a sound tube into the auditory canal 16.

Provision is made in the hearing apparatus 10 that in the event that the sound 12 originates from an external sound source, for instance a conversational partner of the device wearer or a music source, the wanted signal is processed by a signal processor 30 in such a way that the device wearer perceives an output signal 14 adjusted to his/her hearing ability.

In the event that the wearer of the hearing apparatus 11 is speaking, singing or generating other noises with his/her voice, which he/she perceives not only via the hearing apparatus 10 but instead also for instance through bone conduction with his/her ear, the signal processor 30 is switched into a mode by which a neutral sound impression of the own voice is imparted to the user if he/she also perceives this by way of the hearing apparatus 10. The measures to be implemented by the signal processor 30 for this purpose are known per se from the prior art.

In order to switch the signal processor 30 between the two modes, the processing facility 20 implements the method described in more detail below. The method makes it possible on the basis of the ambient sound 12 to reliably detect whether or not the ambient sound 12 is the own voice of the wearer of the hearing apparatus 10. The method does not depend here on acoustic features of an individual information source. A signal of such individual sources would be affected by too large a variance, so that a reliable statement relating to the speaker activity could only be achieved by smoothing the signal over a long period of time. The processing facility 20 therefore could not respond to the rapid changeover between the voice of the wearer of the hearing apparatus 10 on the one hand and the voice of another person. In other acoustic scenarios in which the ambient sound 12 with alternating parts contains both the voice of the wearer and also the ambient noises, no reliable decision at all could be made on the basis of a single source for acoustic features.

For this reason a number of analysis facilities 32, 34, 36, 38 are provided in the processing facility 20, which with respect to independent information sources represent the speaker activity of the wearer of the hearing apparatus. The four analysis facilities 32 to 38 shown here represent only an exemplary configuration of a processing facility. The analysis facilities 32 to 38 may be provided for instance by one or more analysis programs for a digital signal processor.

The analysis facilities 32 to 38 generate output signals in dependence on the wanted signal of the microphone facility 18, which contain data and/or speech activity of the hearing device wearer, i.e. speech activity data 40, 42, 44, 46. The speech activity data 40 to 46 is fused by a fusion facility 48 (FUS-fusion), in other words is combined to form a single signal, which indicates whether the voice of the wearer is active (OVA—Own Voice Active) or whether it is not active (OVNA—Own Voice not Active). The output signal of the fusion facility 48 forms a control signal of the signal processor 30, by which the signal processor 30 is switched hard between the two modes or is faded in softly.

It should generally be noted with respect to the analysis criteria of the analysis facility 32 to 38 that the person skilled in the art, on the basis of simple attempts for a concrete model of the hearing apparatus, can easily find suitable analysis criteria in order to be able to distinguish between an ambient sound 12, which is generated by the voice of the wearer of the hearing apparatus 10 him/herself and an ambient sound 12 which originates from sound sources in the surroundings of the wearer. Exemplary possible embodiments of the analysis facilities 32 to 38 are described below, which have proven particularly expedient. An evaluation of spatial information can be implemented for instance by the analysis facility 32, as to how they can be obtained in a known manner on the basis of several microphone channels (MC—Multi Channel). A direction of incidence 50 can be determined here for instance, from which the ambient sound 12 strikes the microphone facility 18 or at least some of its microphones 24 to 28.

A spectral evaluation on the basis of a single microphone channel (SC Single Channel) can take place for instance by the analysis facility 34. Such analyses are likewise known from the prior art and are based for instance on the evaluation of a signal output in individual spectral bands of the audio signal. Possible spectral information consists in a speaker verification. Such a speaker verification performs a "one from N" speaker detection, i.e. an entirely specific speaker is detected from a number of possible speakers. It can be implemented for instance with the aid of a spectral characteristic of the speaker to be detected, in other words here the wearer of the hearing apparatus 10.

The analysis facility 36 enables a speaker-independent speech activity detection (VAD) to be implemented for instance on the basis of an individual microphone channel. The analysis facility 38 can obtain binaural information from a number of microphone channels, as can also be obtained, by contrast with a microphone array, with microphones arranged further apart.

The output signals of the individual analysis facilities 32 to 38, i.e. the speech activity data 40 to 46, may represent the extracted information in various ways depending on the type of analysis. Expedient forms involve outputting features in the form of discrete, real numbers, outputting the probabilities (in other words real numbers between zero and one) or even outputting concrete decisions relating to speaker activity (in other words possible binary outputs of zero or one). The probabilities may be likelihood values for instance. FIG. 2 shows each of these output forms by corresponding references to features X, probabilities P or decisions D.

An evaluation of the speech activity data 40 to 46 is implemented by the fusion facility 48, the speech activity data ultimately being decisive for the control of the signal processor 30. The fusion facility 48 may be a program or a program section of a digital signal processor for instance.

The type of "fusion" of the activity data 40 to 46 likewise depends here to a large extent on the analysis facilities 32 to 38 used and on the form of speech activity data 40 to 46 (features, probabilities or individual decisions) used. The fusion facility 48 enables speech activity data to be processed in parallel for instance or in series or also using a hybrid approach.

The speech activity data 40 to 46 can be subjected here to an input side weighting by the fusion facility 48. Suitable weightings can be determined for instance of a training process on the basis of training data, which can be emitted for instance by a loudspeaker onto the hearing apparatus 10 as ambient sound 12. The training process allows the weights then to be determined in the form of a covariance matrix, by which a relationship between the speech activity data 40 to 46 on the one hand and the true decision to be made (wearer is or is not speaking) is described. When a covariance matrix is used, the speech activity data 40 to 46 is expediently transmitted to the fusion facility 48 in the form of a vector, in which the numerical values of the analysis results, for instance the probabilities, are combined. In the event that two or more of the analysis facilities 32 to 38 generate features X1, X2, X3, X4 as speech activity data 40 to 46 by way of the covariance matrix, features X summarized therefrom are formed, which are then evaluated in respect of the speech activity of the wearer. The evaluation of the features or the speaker activity can take place for instance on the basis of a method known per se from the field of pattern recognition.

A further possible evaluation method of the fusion facility 48 is a majority decision, which can be routed on the basis of individual decisions D1, D2, D3, D4 to analysis facilities 32 to 38. The result is then an overall decision D.

In the event that two or more of the analysis facilities 32 to 38 generate probability values P1, P2, P3, P4 as speech activity data 40 to 46, these probabilities can be summarized by calculating an average value of these probability values P1 to P4 to form an overall probability P. The overall probability P can then be compared with a threshold value, in order to obtain the final overall decision D.

As a function of the output signal of the fusion facility 48 (OVA/OVNA), a frequency response of the signal path can be set for instance by the signal processor 30, as is formed by the microphone facility 18, the processing facility 30, the signal processing facility 30 and the earpiece 22. Low frequencies of the audio signal can be attenuated for instance in order to prevent an occlusion effect. Provision can likewise be made for a directional microphone not to be adapted when using the voice of the wearer, since it makes no sense to move the main beam of a beam former away from an external source if the wearer of the hearing apparatus 10 is speaking.

Examples are shown overall as to how a robust and reliable own speaker detection can be provided in a hearing apparatus, without any additional microphone being needed for this purpose in the auditory canal 16 of the wearer of the hearing apparatus 10.

The invention claimed is:

1. A hearing apparatus, comprising:

a signal processor, containing:

at least two analysis facilities, each of said analysis facilities configured to obtain speech activity data on a basis of an audio signal received by the hearing apparatus, the audio signal being dependent on speaker activity of a wearer of the hearing apparatus;

a fusion facility configured to receive the speech activity data from said analysis facilities and to identify, on a basis of the speech activity data, whether or not the wearer is currently speaking;

at least one of said analysis facilities configured to determine, in dependence on the audio signal, values for a soft decision or for a probability as to whether the wearer is currently speaking; and at least one of said analysis facilities configured to perform a feature extraction and feature values are determined in dependence on the audio signal, the feature values being selected from the group consisting of a direction of incidence of an ambient sound, a gender of a speaker, a reverberation of the audio signal, spectral characteristics, spectral coefficients and cepstral coefficients.

2. The hearing apparatus according to claim 1, further comprising a microphone facility having at least one microphone and configured to convert an ambient sound arriving at the wearer into a wanted signal, wherein said analysis facilities are configured to process the wanted signal as the audio signal.

3. The hearing apparatus according to claim 1, further comprising an adjustment facility configured to change a mode of operation of the hearing apparatus if said fusion facility detects that the wearer is speaking.

4. The hearing apparatus according to claim 1, further comprising:

an adaptive beamforming facility; and an adjustment facility configured to change a mode of operation of the hearing apparatus, if said fusion facility detects that the wearer is speaking.

5. The hearing apparatus according to claim 1, wherein said fusion facility is configured to weight the speech activity data of said at least two analysis facilities in dependence on an analysis facility from which the speech activity data originated, by means of trained or untrained weighting factors and to logically combine weighted speech activity data.

6. A hearing apparatus, comprising:

a signal processor, containing:

at least two analysis facilities, each of said analysis facilities configured to obtain speech activity data on a basis of an audio signal received by the hearing apparatus, the audio signal being dependent on speaker activity of a wearer of the hearing apparatus;

a fusion facility configured to receive the speech activity data from said analysis facilities and to identify, on a basis of the speech activity data, whether or not the wearer is currently speaking;

at least one of said analysis facilities configured to determine, in dependence on the audio signal, values for a soft decision or for a probability as to whether the wearer is currently speaking;

said fusion facility configured to weight the speech activity data of said at least two analysis facilities in dependence on said analysis facility from which the speech activity data originated, by means of trained or untrained weighting factors and to logically combine weighted speech activity data; and at least one of said analysis facilities configured to perform a feature extraction and feature values are determined in dependence on the audio signal, the feature values being selected from the group consisting of a direction of incidence of an ambient sound, a gender of a speaker, a reverberation of the audio signal, spectral characteristics, spectral coefficients and cepstral coefficients.

7. A method for operating a hearing apparatus by means of a signal processor having at least two analysis facilities, which method comprises the steps of: obtaining speech activity data from an audio signal, being dependent on a speaker activity of a wearer of the hearing apparatus; combining and checking, via the signal processor having a fusion facility, the speech activity data on a basis of combined speech activity data to determine whether or not the wearer is speaking; performing at least one of: determining values via at least one of the analysis facilities in dependence on the audio signal for a soft decision or for a probability that the wearer is currently speaking; weighting the speech activity data of the at least two analysis facilities by the fusion facility by means of trained or untrained weighting factors, in dependence on the analysis facility from which the speech activity data originated; or logically combining weighted speech activity data; performing a feature extraction by means of at least one of the analysis facilities and feature values being determined in dependence on the audio signal; and selecting the feature values from the group consisting of a direction of incidence of an ambient sound, a gender of a speaker, a reverberation of the audio signal, spectral characteristics, spectral coefficients and cepstral coefficients.

8. The method according to claim 7, which further comprises implementing a classification by means of at least one of the analysis facilities and to this end a single decision is already generated by the analysis facility on a basis of a classification criterion, to determine whether or not the wearer is speaking.

9. The method according to claim 7, which further comprises generating, via at least one of the analysis facilities, the speech activity data in dependence on a direction of incidence of an ambient sound.

10. The method according to claim 7, which further comprises generating, via at least one of the analysis facilities, the speech activity data in dependence on spectral values of a frequency spectrum of the audio signal.

11. The method according to claim 7, which further comprises implementing a speaker-independent speech activity detection via at least one of the analysis facilities.

12. The method according to claim 7, which further comprises generating, via at least one of the analysis facilities, the speech activity data in dependence on binaural information formed from audio data obtained on different sides of a head of the wearer.

13. The method according to claim 7, wherein on a basis of individual decisions of the at least two analysis facilities, the fusion facility makes a majority decision as to whether a speaker activity is indicated by the analysis facilities together.

14. The method according to claim 7, which further comprises calculating, via the fusion facility, an average value from soft decisions of speech activity detectors of at least two of the analysis facilities.

15. The method according to claim 7, which further comprises adjusting, via an adjustment facility, a frequency response of the hearing apparatus when speech activity of the wearer is detected by the fusion facility and to this end at least one of: a low frequency part of a wanted signal is attenuated or an adaption of a directional characteristic of a directional microphone facility of the hearing apparatus is interrupted or stopped.

* * * * *